United States Patent [19]

Cowan

[11] Patent Number: 5,051,074

[45] Date of Patent: Sep. 24, 1991

[54] BI-DIRECTIONAL RECIPROCATING PUMP MECHANISM

[76] Inventor: Philip L. Cowan, 2302 Fir Grove Dr., Kingwood, Tex. 77339

[21] Appl. No.: 479,338

[22] Filed: Feb. 13, 1990

[51] Int. Cl.[5] ..... F04B 21/02

[52] U.S. Cl. ..... 417/535; 417/534

[58] Field of Search ..... 417/489, 535, 521, 534

[56] References Cited

U.S. PATENT DOCUMENTS

| | | | |
|---|---|---|---|
| 1,854,773 | 4/1932 | Tannehill | 417/535 |
| 2,509,022 | 5/1950 | Turnquist | 417/534 |
| 2,861,519 | 11/1958 | Houle | 417/489 |
| 3,802,805 | 4/1974 | Roeser | 417/489 |

*Primary Examiner*—Leonard E. Smith
*Assistant Examiner*—Charles G. Freay
*Attorney, Agent, or Firm*—James L. Jackson

[57] ABSTRACT

A reciprocating pump mechanism having a pump body forming a fluid inlet chamber and opposed pump cavities in communication with the fluid inlet chamber. The pump employs a piston having opposed pumping extremities adapted for pumping entry into the respective pumping cavities and is of a length such that with one pumping extremity positioned to its full extent within a pumping cavity the opposite pumping extremity there of is disposed in fluid inletting relation with the opposite pumping cavity. The piston may also include opposed drive shafts at least one of which extends from the pump body. One of the piston shafts may be adapted to be driven by any suitable reciprocating prime mover while the opposite piston shaft is adapted for connection to a similar exposed piston drive shaft of a similar double-acting piston pump to thereby provide for connection of the pumps in tandem driven relation by a single prime mover. The pump mechanism also incorporates a single pump discharge having a pair of check valves in unidirectional fluid controlling communication with the respective piston cavities.

19 Claims, 3 Drawing Sheets

BI-DIRECTIONAL RECIPROCATING PUMP MECHANISM

FIELD OF THE INVENTION

This invention relates generally to pumps for pumping fluids and more particularly relates to a double-acting or bi-directional reciprocating pump mechanism for pumping various fluids such as paint and which is of simple construction and compact size. This invention also concerns pump mechanisms which can be easily operated in tandem or in series from a common driving source for metered pumping of different fluids according to a specific ratio without any risk of off-center loading in the event the fluid supply for one of the pumps should become depleted. This invention also concerns pump mechanisms which can be pressure fed by a pressurized external source such as a supply pump if desired.

BACKGROUND OF THE INVENTION

Double acting or bi-directional reciprocating pump mechanisms are often utilized in the pumping of fairly viscous liquids such as paint because these types of pumps are resistant to fouling such as by accumulated paint residue or by the particulate constituents often contained within paint. These types of pumps are also capable of adequately pumping fairly viscous fluid mediums such as polymers for protective coatings and liquid compositions having a relatively high percentage of particulate incorporated therein.

In circumstances where high volume reciprocating pump mechanisms are employed, it may be desirable to provide the inlet of the pump mechanism with a pressurized source of fluid being pumped such as by means of an external fluid supply pump. In some circumstances where pneumatic motors are utilized to drive a reciprocating pump mechanism the application of fluid pressure to the pump supply chamber can induce seal leakage at the drive motor shaft seal and thereby cause the internal components of the drive motor to be contaminated with the fluid being pumped. It is desirable, therefore, to provide a reciprocating pump mechanism having the capability of being provided with an external pressurized fluid supply source under circumstances where such is desired for high volume pumping of a fluid medium and under circumstances where any seal leakage that might occur will not cause internal contamination of the pneumatic motor.

Most reciprocating pump mechanisms are fairly complex and therefore of relatively expensive nature. It is desirable to provide a double-acting or bi-directional pump mechanism that is of simple and low cost nature.

In circumstances where different fluids are pumped by different pumps and must be delivered according to a predetermined ratio, it has been found very difficult to set up two or more independently powered pumps and then adjust them so that a precise volumetric ratio is delivered at all times. For this reason dual or multiple pumps are typically powered by a single power source. The disadvantage of this arrangement, however, is that the power source can be subjected to severe and damaging off-center loading if the fluid supply of one of the pumps becomes depleted or becomes blocked for any reason. Off-center loads can also be caused by pumps of different displacement. It is desirable therefore, to provide a pump mechanism that efficiently provides for coupling of two or more pumps to a single prime mover without subjecting the prime mover to any possibility of off-center loading.

THE PRIOR ART

Schlosser et al. in U.S. Pat. Nos. 4,035,109 and 4,209,442 describe a fluid pump for viscous materials which combines a reciprocating fluid powered drive motor connected to two single acting pumps, one on each end of the drive motor, to provide a double-acting fluid pump for viscous materials. This type of pump has found commercial acceptance but suffers from mechanical complexity because of the physical separation of the two pumping sections and from problems of contamination of the driving motor by fluid leakage from the pump section. In general, it is not recommended that these pumps be pressure fed because of the problems of internal contamination of the driving motor.

SUMMARY OF THE INVENTION

It is a principal feature of the present invention to provide a double-acting reciprocating pump mechanism which may be independently powered or which may be selectively coupled for operation of two or more pumps from a common driving source such as for the metering of different fluids according to a specified ratio.

It is another feature of this invention to provide a novel pneumatic powered double-acting pumping mechanism comprising two single acting pumps wherein fluid leaking past the pump seals cannot enter into and contaminate the reciprocating driving motor.

It is also a feature of this invention to provide a double-acting pump mechanism which has the capability for receiving a pressurized fluid inlet supply to assist in the volumetric pumping capability of the pump mechanism.

It is also an important aspect of this invention to provide a novel pump mechanism incorporating a piston for its pumping operation, which pumping mechanism is designed to provide full support and alignment of the piston at all positions of its stroke. It is an even further feature of this invention to provide a novel double-acting pump mechanism permitting two or more similar pumps to be interconnected in tandem and driven by a common prime mover in such manner as to insure that no off-center loads are applied to the prime mover in the event one of the pumps were to run out of fluid or if the pumps have different pumping capacities.

It is an even further feature of this invention to provide a novel double-acting reciprocating pump mechanism that is of simple nature, is reliable in use and low in cost.

Briefly, a double-acting piston operated reciprocating pumping mechanism is provided which incorporates a pump body structure defining a fluid supply chamber having a fluid inlet in communication therewith and forming a pair of closed, generally cylindrical pumping chambers each being in communication with the supply chamber. An elongated piston operating shaft extends completely through at least one end of the housing of the pump mechanism and is provided for connection at one end to a reciprocating prime mover such as the reciprocating drive shaft of a hydraulic, pneumatic or mechanical motor. The shaft may extend through both sides of the pump housing and be adapted for connection at its opposite end to the piston operated shaft of a similar reciprocating pump mechanism which may have a similar or different pumping capacity. The pump chambers are each in communication via check valves with a discharge conduit or passage which is in communication with a single pump discharge outlet. The length of the piston relative to the respective lengths of the pump cavities and the length of the fluid inlet chamber is such that, with the piston at one extremity of its stroke, the opposite extremity of the piston is completely withdrawn from the respective pump cavity, thus permitting the cavity to become filled with fluid from the inlet chamber. The shaft or shafts extending from the piston are sealed with respect to the pump body by readily replaceable seals.

The pump mechanism of this invention is of very simple construction and is susceptible of simple and efficient plumbing for both inlet and discharge of the fluid being pumped. The pump mechanism may be supplied by a pressure source such as a remote supply pump without any risk of internally contaminating the pneumatic drive motor or any other prime mover for the pump.

It is the purpose of the subject invention to provide a double-acting pump for fluids, such as paint, which will be simple in construction and compact in size. It is a further purpose of the invention to provide a pump which can be easily adapted to operate two or more pumps from a common driving source for metering of different fluids in a specified ratio. The pump can be pressure fed by an external pump if required.

In the subject invention, two single acting pumps are utilized, situated on either side of a common inlet conduit and driven by a rod which traverses through at least one end of the pump assembly. The advantages of this design will be evident from the following description of one embodiment of the invention as shown in FIG. 1 which shows a section through the cluster of the pump.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

In the Drawings:

FIG. 1 is an elevational view illustrating two pumps each constructed in accordance with the present invention and being connected in tandem for operation by a single prime mover.

FIG. 2 is a sectional view of a double-acting pump mechanism constructed in accordance with the present invention.

FIG. 3 is a partial sectional view of a double acting pump mechanism representing an alternative embodiment of this invention.

FIG. 4 is a partial sectional view of a double-acting pump mechanism representing a further alternative embodiment of this invention.

DETAILED DESCRIPTION OF PREFERRED EMBODIMENT

Figure 1:
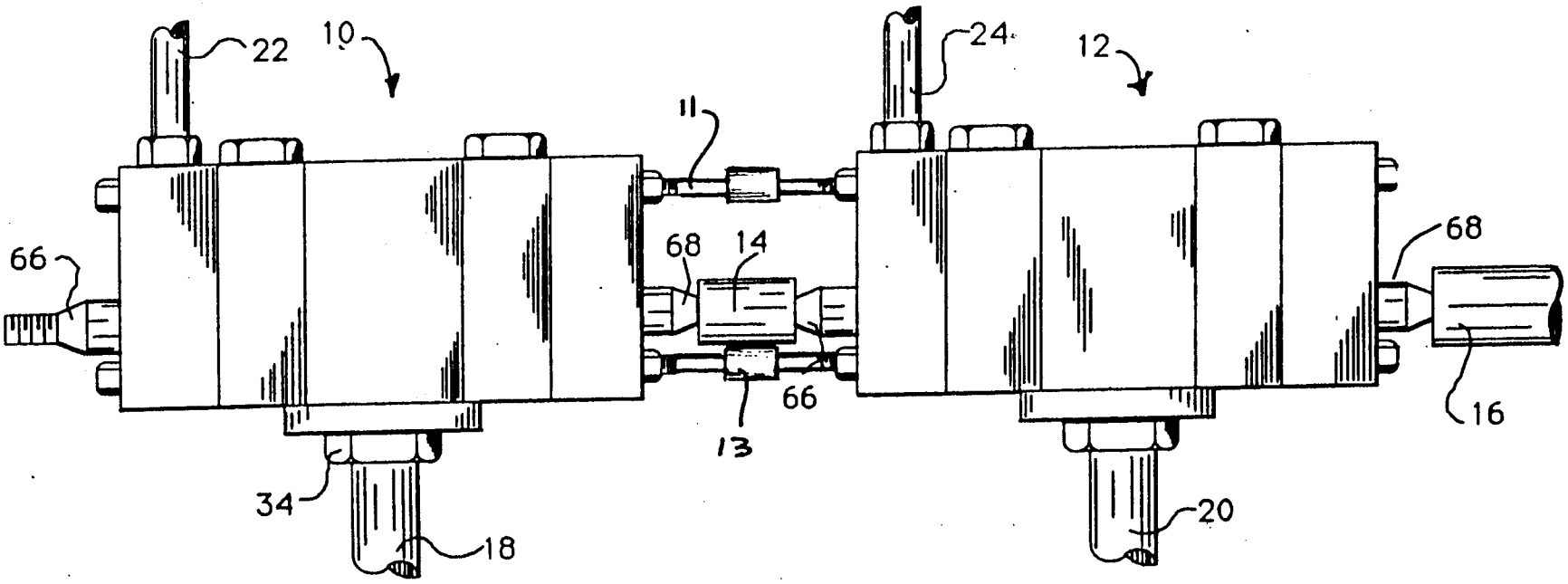
Figure 2:
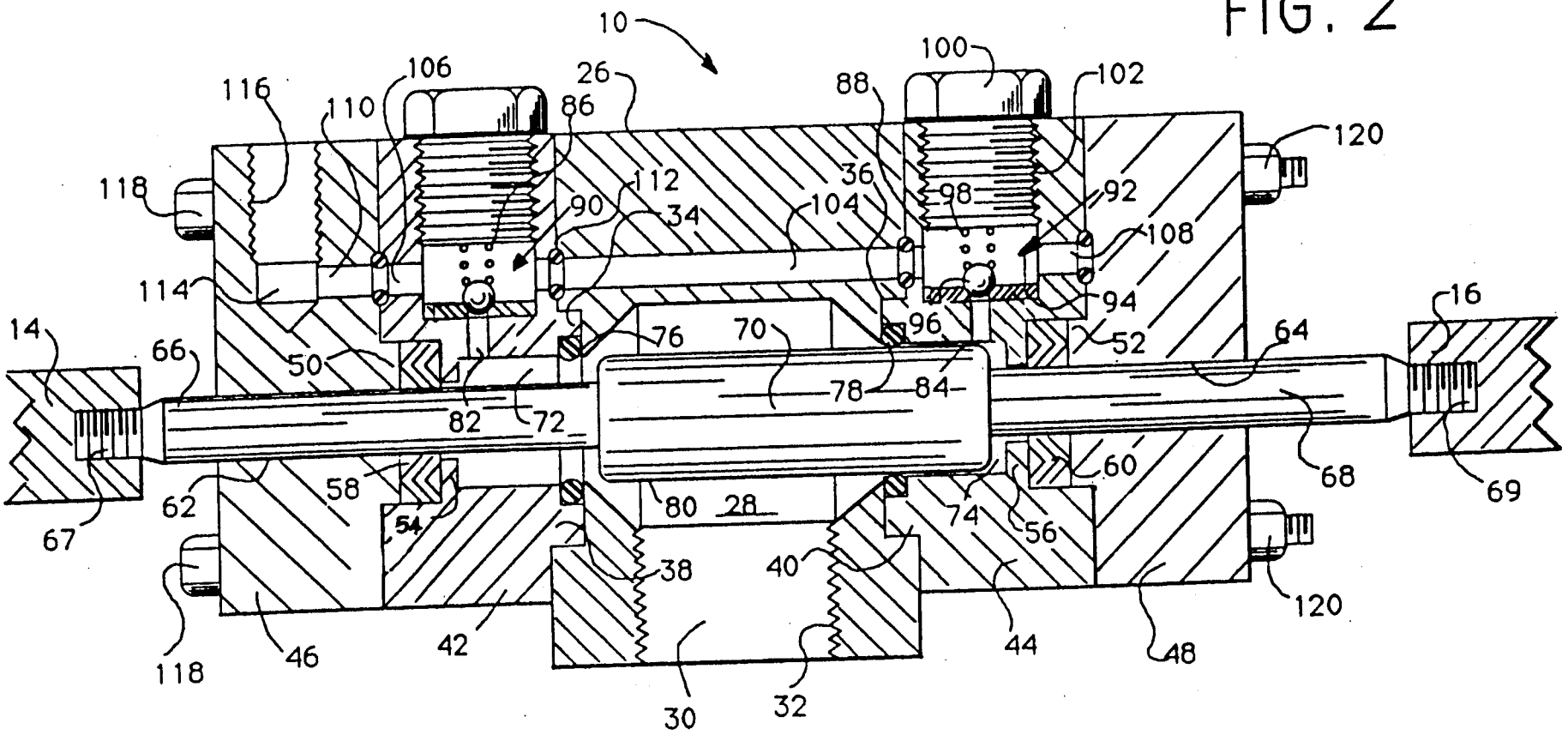

Referring now to the drawings and first to FIG. 1, a pair of double-acting pump mechanisms are illustrated generally at 10 and 12, each being constructed in accordance with FIG. 2. The pumps 10 and 12 are shown to be interconnected in tandem by structural members 11 and 13 which stabilize the pumps and resist forces that might otherwise tend to move the pumps toward or away from one another. Power transmission between the respective drive shafts of the pumps 10 and 12 is established by means of a coupling 14 in a manner to be described in detail hereinbelow. The pumps 10 and 12 are coupled in such manner as to be powered by a single prime mover 16 which, for example, may be the drive shaft of a double-acting reciprocating hydraulic operator or the reciprocating drive shaft of any suitable electric, pneumatic, hydraulic, prime mover or the like.

Each of the pumps 10 and 12 are adapted for efficient plumbing to provide for adequate supply of fluid inlet thereto via inlet conduits 18 and 20 and for discharge of pump fluid therefrom via discharge conduits 22 and 24.

Referring now to FIG. 2, the double-acting reciprocating piston pump mechanism is illustrated generally at 10 and incorporates a central body element 26 which forms a fluid inlet chamber 28 having a fluid supply passage 30 in communication therewith. As shown, the fluid supply passage defines internal threads 32 which are adapted to receive a suitable plumbing connector shown at 34 in FIG. 1 for connection of a fluid supply conduit 18 to the inlet chamber 28.

The central pump element 26 further defines opposed alignment receptacles 34 and 36 which receive respective projections 38 and 40 of housing elements 42 and 44 so as to dispose these housing elements in proper registry with the central housing element. Terminal housing elements 46 and 48 are provided which define retaining and orienting projections 50 and 52 respectively which function to insure positioning of the respective body sections 42–46 and 44–48 in proper registry and to serve as respective seal retainers. The body sections 42 and 44 define seal chambers or packing glands 54 and 56 within which are disposed packing members or assemblies 58 and 60 respectively. The projections 50 and 52 function to secure the packing assemblies in proper position within the respective packing glands.

The respective terminal body elements 46 and 48 further define shaft passages 62 and 64 through which extend a pair of drive shafts 66 and 68 respectively. The drive shafts extend from a piston member 70 which is disposed for reciprocation within the fluid inlet chamber 28 and within pumping cavities 72 and 74 which are defined by the respective body elements 42 and 44. Although the piston drive shafts 66 and 68 are preferably formed integrally with the piston member 70, they may be connected to the piston in any suitable manner that establishes positive driving reciprocation of the piston under conditions of high pressure pumping. Further, the piston 70 and its drive shafts 66 and 68 function as an integral force transmitting member to thus transmit the force of a prime mover such as shown at 16 completely through the housing of the pump mechanism so that it may be connected in driving relation by means of a suitable coupler 14 to the drive shaft of a subsequent, similar double-acting pump mechanism in the manner shown in FIG. 1. In fact, a series of similar pumps may be connected in tandem and operated by a single prime mover. This insures that all of the pumps are operated at the same pumping speed. The volumes of fluid pumped by the individual tandem connected pumps may be identical, if desired, or, in the alternative, may establish a desired volumetric ratio. Although the external dimensions of the pumps may be substantially identical, the volumetric differences of pumping capability will be controlled by the respective dimensions of the pump cavities 72 and 74 and the dimension of the piston 70. In the event a user should desire a particularly designed pumping ratio such as 3–1 for example, the respective dimensions of the pump cavities of the pumps operated by a single prime operator will establish these differences of volumetric pumping capability.

When the piston 70 is disposed within a pump cavity such as shown at 70–74 in FIG. 2, one of the piston seals 76 and 78 will establish sealing relation with the outer cylindrical surface 80 of the piston. Thus, the piston establishes positive pumping in respect to each pump cavity to insure that the pump has the capability of high pressure pumping as well as pumping at high volume.

For discharge of pumped fluid from the respective pump cavities 72 and 74, the housing elements 42 and 44 define discharge ports 82 and 84 that conduct pumped fluid to respective discharge chambers 86 and 88. Within these discharge chambers are located check valve assemblies shown generally at 90 and 92. Each check valve assembly incorporates a valve seat 94 against which is seated a ball check member 96 that is urged against the seat by means of a compression spring 98. The compression spring is provided with a preload force by means of a retainer plug 100 which is threadedly received within an internally threaded body opening 102. The plug member 100 also serves as the closure for an access opening defined by the opening 102 which is of sufficient size for insertion and removal of the check valve assembly, thus providing for ease of pump maintenance.

The body elements 26, 42, 44 and 46 define discharge passage segments 104, 106, 108 and 110 which cooperatively form a single discharge passage extending through the pump body structure. To insure against leakage between the pump elements, a plurality of passage seal elements such as shown at 112 are provided at the joints between the body elements. The discharge passage 104 is in communication with a discharge outlet opening 114 which is internally threaded as shown at 116 to receive an appropriate retainer that secures the discharge conduit 22 at the discharge outlet of the pump body.

The body elements are retained in integral assembly by means of a plurality of bolts 118 which extend through aligned passages in the body elements and have nuts 120 that are appropriately tightened to threaded extremities of the bolts. It is intended that any other suitable means may be employed to secure the body elements in assembly.

Utilization of a pump shaft which is integral with or connected to the piston of the pump and extends through the full length of the pump housing provides the advantage of insuring that the piston is provided with efficient support and alignment throughout the full length of its stroke. It is also evident that providing threads or some suitable attachment means on each end of the piston shafts will permit connection of the piston shaft of a second similar single or double-acting reciprocating pump assembly to the exposed end of the piston shaft. This feature permits connection of a second similar pump assembly to the piston shaft so as to be driven by the same prime mover as the first pump. This feature permits a number of similar pumps to be interconnected in tandem and to be driven by a single prime mover. A tandem pump arrangement thus provided would permit metering of two different fluids in proportions that could be controlled by appropriate selection of the relative piston diameters on the two pumps. A significant advantage of this type of proportioning pump is that no off-center loads will be applied to the primer mover in the event one of the two pumps would run out of fluid or if the pistons of the pumps are of significantly different diameters. Off-center loading is a significant problem in the design of conventional proportioning systems where the fluid pumps are generally driven in parallel from a single prime mover.

Since potential contamination of a hydraulic motor or air motor is not a probability, the pump mechanism of this invention is readily adapted for pressurized supply of fluid to the inlet chamber 28. Therefore, a remote supply pump may be effectively employed to provide high volume pressurized supply of fluid to the inlet chamber to thus provide for high volume, high pressure discharge of fluid at the discharge outlet 116.

Double acting pump mechanisms of the nature disclosed herein may be of relatively small size to thus permit their efficient connection in tandem. Further, the simplicity of this pump mechanism effectively insures that no complex plumbing will be required to provide a suitable pumping mechanism including the pumping of multiple fluids. The simplicity and efficiency of design of the double-acting piston pump mechanism of this invention effectively allows similar pumps of different volumetric pumping capacity to be interconnected and driven by a single prime mover to thereby provide pumped fluid discharge at a predetermined ratio.

In view of the foregoing, it is evident that the present invention is one well adapted to attain all of the objects and features hereinabove set forth, together with other objects and features which are inherent in the apparatus disclosed herein.

As will be readily apparent to those skilled in the art, the present invention may be produced in other specific forms without departing from its spirit or essential characteristics. The present embodiment, is therefore, to be considered as illustrative and not restrictive, the scope of the invention being indicated by the claims rather than the foregoing description, and all changes which come within the meaning and range of the equivalence of the claims are therefore intended to be embraced therein.

Figure 3:
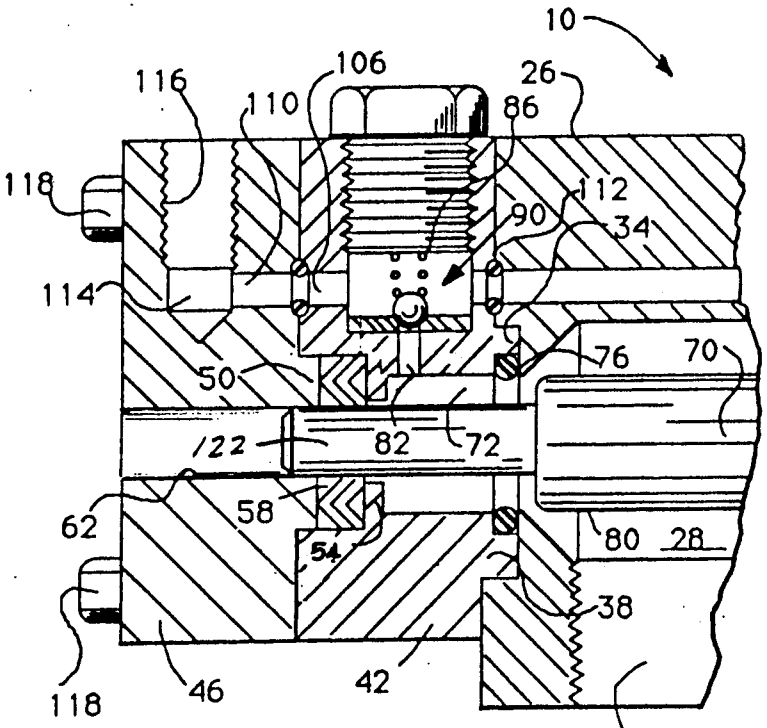

Referring now to FIG. 3, an alternative embodiment of the present invention is disclosed with like reference characters identifying like components as compared with FIG. 2. In this embodiment it is intended that an opposed, driven shaft of the piston 70 remain within the confines of the pump housing during full stroke reciprocation of the piston. As shown at the left hand portion of FIG. 3, the piston 70 is provided with a driven shaft 122 which is received in close fitting relation within the shaft passage 62 and which is sealed with respect to the pump housing by means of the annular packing member 58. The stub shaft 122 provides a piston guiding function to insure that the piston remains fully stabilized at all positions of its reciprocal movement within the housing. The passage 62, being open to the atmosphere, prevents the build-up of any pressure or vacuum within the passage as the shaft 122 reciprocates therein.

It is also within the scope of this invention to provide a double-acting piston pump mechanism wherein the piston 70 is aligned and guided by the single input shaft 68 shown in FIG. 2. The pump cavity 72 defined within housing element 42 is simply in the form of a cylindrical blind bore which is communicated via cavity outlet passage 82 with the check valve mechanism 90 The body element 46 rather than serving as a sealed retainer in the manner shown in FIGS. 2 and 3, merely defines discharge passage section 110 and the discharge opening 114.

OPERATION

Figure 4:
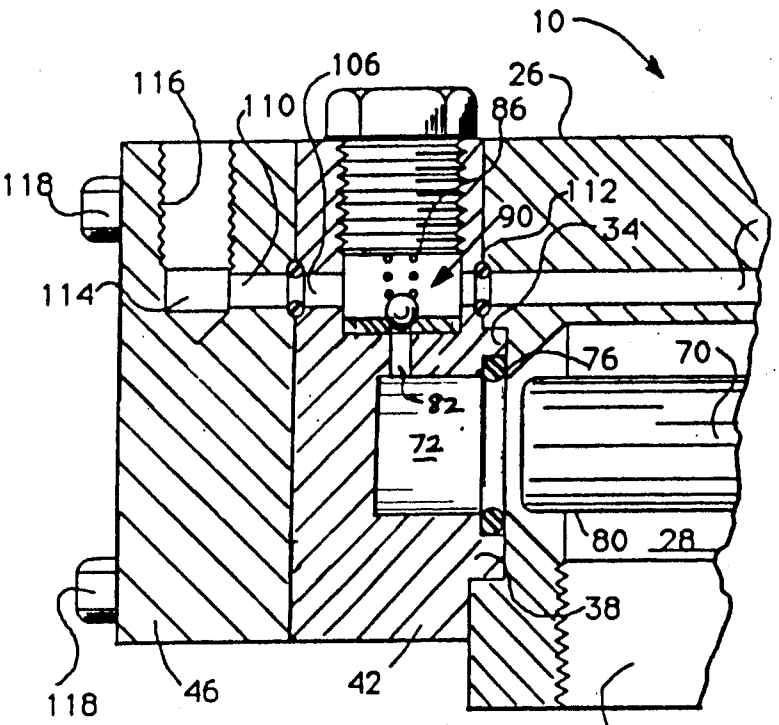

Referring now to FIG. 2, operation of a single stroke of the pump mechanism of this invention will be described in detail. It is to be born in mind that the embodiments of FIGS. 3 and 4 will function in the same manner as compared with FIG. 2, with the exception that provision is not made for tandem driving of these pumps by means of a single prime mover.

Assuming that shaft 16 to which the piston shaft 68 is connected represents the reciprocating shaft of a prime mover, the shaft 16 will be positioned at the full extent of its travel to the right as shown in FIG. 2. In this position, the prime mover shaft 16 will move to the left, thereby imparting linear movement to the pump drive shaft 68 thereby moving the piston 70 and the opposite piston shaft 66 to the left. At the beginning of this stroke by virtue of the clearance between the left end of the piston 70 and the piston seal 76, fluid within the inlet chamber 28 will have entered the pumping chamber 72 and filled it to its full extent. As explained above, the inlet chamber 28 may be in fluid receiving communication with an external pressurized source of fluid such as a remote supply pump thereby causing the presence of a positive pressure within the inlet chamber 28. This insures the high volume high pressure pumping capability of this pump mechanism.

The piston 70 is moved to the left by the prime mover shaft 16 until its outer cylindrical surface 80 establishes sealing engagement with the piston seal 76. When this occurs, fluid is trapped within the pumping chamber 72. Further movement of the piston 70 to the left displaces fluid within the pumping chamber through the discharge port 82 and across the check valve 90 into the discharge chamber 86. This displaced fluid is conducted via the discharge passage sections 106 and 110 to the discharge outlet opening 114 to a suitable discharge conduit which is received by the threads 116 of the body element 46.

During movement of the piston 70 to the left, as explained above, the check valve 92 will prevent reverse flow of fluid from the discharge chamber 88 to the pumping chamber 74. Thus, such movement of the piston develops a vacuum within the pumping chamber 74 during the time that fluid is displaced from the pumping chamber 72. This vacuum condition will be relieved when the right hand end of the piston breaks its sealed relationship with the piston seal 78, whereupon fluid within the inlet chamber 28 will be drawn into the pumping cavity 74 by virtue of negative pressure and by the nature of positive pressure within the inlet chamber. It is seen, therefore, that for a time during its stroke, the piston will be in sealed relationship with both the piston seals 76 and 78 and during portions of its stroke its sealed relationship with respective ones of these seals will be broken.

When the piston has moved to the left to the full extent of its stroke, the right hand end of the piston will have cleared its respective piston seal 78. This feature occurs due to the axial length of the piston which exceeds the specified length of the inlet chamber 28 as defined by the spacing of the piston seals 76 and 78.

After moving to the left to the full extent of its stroke, the prime mover shaft 16 will reverse its direction, thereby forcing the piston 70 to the right. When this occurs, fluid contained within the pumping chamber 74 is displaced by the right end of the piston while at the same time the left end of the piston is developing a vacuum condition within pumping chamber 72. This vacuum condition is broken as soon as the cylindrical surface 80 of the piston breaks its sealed relation with the respective piston seal 76, whereupon fluid from the inlet chamber 28 is drawn by the vacuum condition into the pumping chamber 72. Movement of the piston to the right will continue until it reaches the full extent of its stroke as shown in FIG. 2, whereupon the prime mover shaft 16 again reverses its direction and begins movement of the piston to the left to repeat the pumping stroke.

In accordance with the embodiment illustrated in FIG. 2, the opposed piston shaft 66, extending from the pump body structure will impart driving force to a connector or shaft 14 which induces similar reciprocation of a pump mechanism connected in tandem relation therewith in the manner described above in connection with FIG. 1. The second tandem pump need not have the same pump cavity displacement as the first pump. In fact, the dimensions of its pump cavities and piston may be such that the output of the second pump establishes a predetermined ratio with the output of the first pump. Thus, the combined outputs of the pumps shown in FIG. 1 may have any suitable ratio. Further, two or more pumps may be interconnected in tandem relation in the manner shown at FIG. 1 as long as the power output of the prime mover is sufficient for operation thereof. The aligned, coaxial relation of the shafts 66 and 68 with the piston 70 insures efficient transition of pumping force from the prime mover through various tandem relating pump mechanisms. Further, this aligned piston and shaft relationship effectively insures straight-through transition of forces through the bodies of aligned pumps and thereby permits the pumps to operate in tandem without subjecting the prime mover to any off-center loading even under circumstances where the supply of one of the pumps may be depleted. The aligned piston and shafts also insure that pumps of differing displacement do not subject the prime mover to any off-center loading.

What is claimed is:

1. A double-acting reciprocating pump mechanism comprising:

(a) pump body means forming fluid inlet means which is in communication with an axially elongated fluid inlet chamber and defining a pair of opposed spaced axially aligned piston cavities and having said axially elongated fluid inlet chamber located between said piston cavities for introduction of fluid into said piston cavities, said pump body means defining opposed spaced axially aligned piston shaft passages at least one side thereof extending from one of said piston cavities and opening exteriorly of said pump body means;

(b) pump discharge means being formed by said pump body means and disposed to receive fluid displaced from said piston cavities;

(c) piston means being positioned for reciprocal movement within said pump body means and having opposed axially aligned pumping extremities being movable within said opposed piston cavities for displacement of fluid from said piston cavities to said discharge means; and (d) pump drive shaft means extending from at least one pumping extremity of said piston means through at least one of said opposed piston cavities, said pump drive shaft means extending through said one of said drive shaft passages and projecting from at least one side of said pump body means, said pump drive shaft means having a connector thereon for selective connection thereof to an output drive shaft of a reciprocating pump motor and for selective connection thereof to a reciprocating shaft of a similar reciprocating pump mechanism.

2. The double-acting reciprocating pump mechanism of claim 1, wherein said pump drive shaft means comprises:

a pair of opposed axially aligned drive shafts each extending through respective ones of said opposed piston cavities and projecting from respective opposed sides of said pump body means.

3. The double-acting reciprocating pump mechanism of claim 2, wherein:

at least one of said opposed drive shafts forms connection means for selective interconnection to a shaft of an adjacent reciprocating mechanism.

4. A reciprocating piston pump mechanism, comprising:

(a) pump body means forming fluid inlet means which is in communication with an axially elongated fluid inlet chamber, said axially elongated inlet chamber being axially aligned with a pair of opposed, spaced axially aligned piston cavities formed in said pump body means, having opposed piston openings in fluid receiving communication with said fluid inlet chamber, said pump body means defining opposed spaced axially aligned pump shaft passages at least one side thereof extending from one of said piston cavities and opening exteriorly of said pump body means;

(b) pump discharge means being formed by said pump body means and being in communication with each of said piston cavity means;

(c) means permitting undirectional flow of fluid pumped from said piston cavity means to said pump discharge means;

(d) piston means being disposed for reciprocation within said axially elongated inlet chamber and having opposed axially aligned pumping extremities disposed for pumping relation with respective one of said piston cavity means, said piston means defining an axial length such that at one extremity of its stroke one pumping extremity thereof being disposed in sealed relation within one of said piston cavities and the opposite pumping extremity of said piston being disposed in unsealed relation with the opposite piston cavity;

(e) pump drive shaft means extending from at least one pumping extremity of said piston means through at least one piston cavity means and being in sealed relation with said pump body means, said pump drive shaft means projecting from at least one side of said pump body means and adapted for connection to the output drive shaft of the pump drive motor means.

5. The reciprocating piston pump mechanism of claim 4, wherein said pump drive shaft means comprises:

a pair of piston shafts extending from respective axial pumping extremities of said piston means and projecting from opposed sides of said pump body means and having shaft connectors at the respective ends thereof adapted for selective connection to an output drive shaft of a reciprocating pump motor and for selective connection to an input drive shaft of a similar reciprocating pump mechanism.

6. The reciprocating piston pump mechanism of claim 4, wherein:

(a) the spacing of said piston openings of said axially aligned piston cavities defines a specified length;

(b) said piston cavity means being a pair of opposed piston cavities each being in communication by said piston openings with said fluid inlet chamber; and (c) said piston means having a length exceeding said specified length.

7. The reciprocating piston pump mechanism of claim 4, wherein:

(a) said piston means defines a longitudinal axis; and (b) said pump drive shaft means defines longitudinal axes being coincident with said longitudinal axis of said piston means.

8. The reciprocating piston pump mechanism of claim 4, wherein:

said piston means defines an axial length such that at one extremity of its stroke one end thereof is received to its full extent within one of said piston cavities and the opposite end of said piston is clear of the other of said piston cavities.

9. The reciprocating piston pump mechanism of claim 4, including:

shaft seal means being supported within said pump body means and establishing said sealed relation between said pump drive shaft means and said pump body means.

10. The reciprocating piston pump mechanism of claim 4, including:

piston seal means being supported within said pump body means and forming said opposed piston openings and establishing sealed relation between said pump body means and said piston means during the sealing and fluid pumping relation of said pumping extremities with respective piston cavity means.

11. A double-acting reciprocating pump mechanism, comprising:

(a) pump body means forming an axially elongated fluid inlet chamber means and opposed spaced axially aligned piston cavities each being axially aligned with said fluid inlet chamber and in fluid communication with said fluid inlet chamber means, said pump body means defining opposed spaced axially aligned piston shaft passages at least one side thereof extending from one of said piston cavities and opening exteriorly of said pump body means;

(b) pump discharge means being formed by said pump body means and being in communication with said opposed piston cavities;

(c) means permitting unidirectional flow of pumped fluid from said opposed piston cavities to said pump discharge passage means;

(d) piston means being disposed for reciprocation within said pump body means and forming opposed pumping extremities adapted to be received in pumping relation within respective ones of said axially aligned opposed piston cavities, said piston means defining an axial length such that at one extremity of its stroke one pumping extremity thereof is disposed in sealed relation within one of said piston cavities and the opposite pumping extremity of said piston is disposed in unsealed relation with the opposite piston cavity;

(e) pump drive shaft means extending from at least one end of said piston means and extending through at least one of said opposed piston cavities, said pump drive shaft means being disposed in sealed relation with said pump body means, said pump drive shaft means projecting from said pump body means and having a connector thereon adapted for selective connection to the output drive shaft of a pump drive motor.

12. The double-acting reciprocating pump mechanism recited in claim 11, wherein:

said piston cavities each define a piston opening the spacing of which defines a specified length said piston defining an axial length exceeding said specified length.

13. The double-acting reciprocating pump mechanism recited in claim 11, wherein:

said axial length of said piston is such that at one extremity of its stroke with one end thereof received to its full extent within one of said piston cavities, the opposite end of said piston is positioned to permit ingress of fluid from said fluid inlet chamber means into the other of said pump cavities.

14. The double-acting reciprocating pump mechanism recited in claim 11, wherein:

piston seal means is located about each of said piston cavities and is adapted for sealing engagement with a respective pumping extremity of said piston means during the presence of said respective pumping extremity of said piston means within a piston cavity.

15. The double-acting reciprocating pump mechanism recited in claim 14, wherein:

said piston seal means is of annular configuration and is disposed generally at the juncture of said piston cavity with said fluid inlet chamber means.

16. The double-acting reciprocating pump mechanism recited in claim 11, wherein:

(a) said piston means is of elongate configuration defining a longitudinal axis and having opposed generally cylindrical fluid pumping ends; and (b) said pump drive shaft means being a pair of drive shafts each being disposed in coaxial relation with one another and with said longitudinal axis of said piston, said drive shafts projecting from opposed sides of said pump body means.

17. The double-acting reciprocating pump mechanism of claim 16, wherein each of said drive shafts define connection means permitting selective operating connection of said drive shafts to a reciprocating drive motor and to a drive shaft of a similar pump mechanism.

18. The double-acting reciprocating pump mechanism recited in claim 11, wherein said means permitting unidirectional flow of fluid comprises:

a pair of check valve assemblies each being disposed in fluid communication with respective ones of said pump chambers and with said pump discharge means.

19. The double-acting reciprocating pump mechanism recited in claim 11, wherein:

shaft seal means is disposed within said pump body means and establishes sealed relation between said pump body means and said pump drive shaft means to prevent leakage.

* * * * *